US006624585B2

(12) United States Patent
Pruett

(10) Patent No.: US 6,624,585 B2
(45) Date of Patent: Sep. 23, 2003

(54) ULTRA-COMPACT IGNITER CIRCUIT FOR ARC DISCHARGE LAMP

(75) Inventor: Henry Frazier Pruett, Sandy, OR (US)

(73) Assignee: InFocus Corporation, Wilsonville, OR (US)

( * ) Notice: Subject to any disclaimer, the term of this patent is extended or adjusted under 35 U.S.C. 154(b) by 0 days.

(21) Appl. No.: 09/950,749

(22) Filed: Sep. 10, 2001

(65) Prior Publication Data

US 2003/0057878 A1 Mar. 27, 2003

(51) Int. Cl.[7] ..... H05B 37/02; H05B 39/04
(52) U.S. Cl. ..... 315/151; 315/159
(58) Field of Search ..... 315/149, 150, 315/151, 156, 157, 158, 159, 289, 290, 291, 307

(56) References Cited

U.S. PATENT DOCUMENTS 4,382,211 A * 5/1983 Takematsu ..... 315/151
4,800,323 A * 1/1989 Sikora ..... 315/219
5,051,665 A 9/1991 Garrison et al.
5,170,099 A * 12/1992 Ueoka et al. ..... 315/175
5,241,242 A * 8/1993 Daub ..... 315/127
5,497,001 A * 3/1996 Filo ..... 250/271
5,635,800 A * 6/1997 Taubert ..... 315/171
5,990,633 A 11/1999 Hirschmann et al.
6,104,147 A * 8/2000 Nakamura et al. ..... 315/103
6,107,754 A * 8/2000 Kim ..... 315/209 R
6,114,797 A * 9/2000 Bishop et al. ..... 310/318
6,373,199 B1 * 4/2002 Erhardt et al. ..... 315/209 R
6,437,515 B1 * 8/2002 Kamoi et al. ..... 315/209 R

FOREIGN PATENT DOCUMENTS

WO WO99/48133 9/1999
WO WO00/77826 A1 12/2000

* cited by examiner

*Primary Examiner*—Don Wong
*Assistant Examiner*—Minh D A
(74) *Attorney, Agent, or Firm*—Schwabe, Williamson & Wyatt, P.C.

(57) ABSTRACT

An igniter circuit for an arc discharge lamp comprises a DC to AC converter, a transformer, an AC to DC converter and high-voltage DC energy storage which is capable of discharging electrical energy to ignite the arc discharge lamp. In an embodiment, the igniter circuit is capable of producing arc discharge by using a low-voltage DC power supply and is suitable for implementation in a lightweight compact portable projector.

24 Claims, 1 Drawing Sheet

ULTRA-COMPACT IGNITER CIRCUIT FOR ARC DISCHARGE LAMP

BACKGROUND OF THE INVENTION

1. Field of the Invention

The present invention relates to arc discharge lamps, and more particularly, to igniter circuits for arc discharge lamps.

2. Background Art

Arc discharge lamps have been widely used in fixed and portable projectors because of the ability of arc discharge lamps to produce high intensity light. In a conventional arc discharge lamp, high intensity light is produced by arc discharge in an ionized gas. In order to ionize the gas in a conventional arc discharge lamp, an electric discharge at a sufficiently high voltage is required to ignite a spark in the spark gap of a spark generator for ionizing the gas.

In a conventional projector with an arc discharge lamp, a high-voltage step-up transformer is typically required to produce a sufficiently high voltage required for ignition. Conventional methods of producing the high voltage required for ignition of an arc discharge lamp typically include the use of a pulse direct current (DC) waveform, a rectified alternating current (AC) square waveform, or a flyback voltage from an inductor, for example. These conventional methods typically require the use of large magnetic components which suffer limitations caused by parasitic capacitance in the high-voltage windings and poor coupling between the windings. Furthermore, the high-voltage step-up transformer used in a conventional igniter circuit for an arc discharge lamp is usually heavy and bulky, thereby making it unattractive for use in lightweight portable projectors.

Therefore, there is a need for a lightweight compact igniter circuit for an arc discharge lamp in a lightweight portable projector. Furthermore, there is a need for an igniter circuit that is capable of producing ignition for the arc discharge lamp by utilizing a low-voltage DC power source.

BRIEF DESCRIPTION OF THE DRAWINGS

The present invention will be described with respect to particular embodiments thereof, and references will be made to the drawings in which.

DETAILED DESCRIPTION

Figure 1:
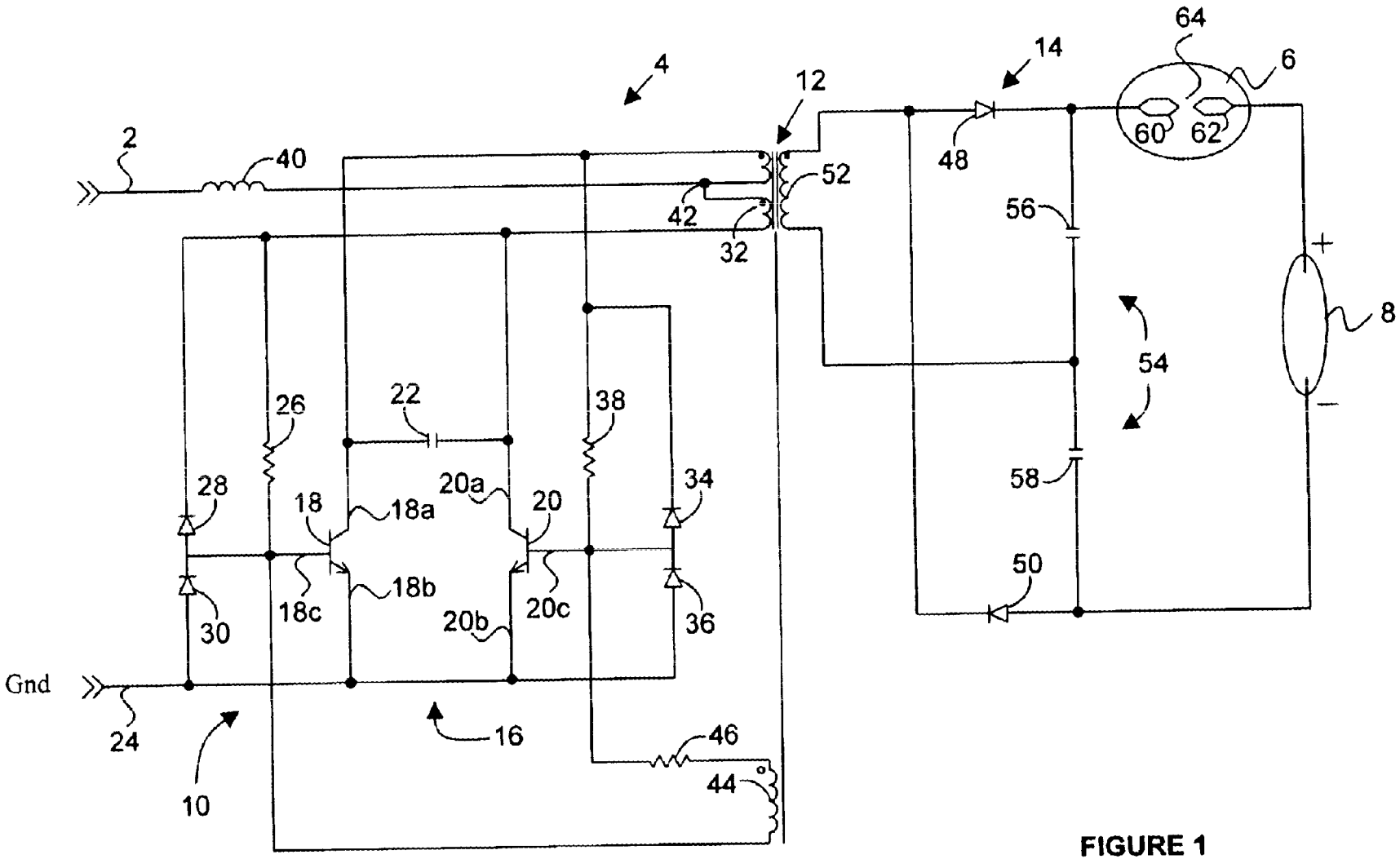
FIG. 1 shows a diagram of an igniter circuit for an arc discharge lamp according to an embodiment of the present invention.

FIG. 1 shows a diagram of an igniter circuit for an arc discharge lamp according to an embodiment of the present invention, suitable for implementation in a lightweight portable projector which uses a low voltage direct current (DC) power supply. In FIG. 1, a DC input line 2 carries a relatively low input DC voltage, for example, a DC voltage from a twelve-volt battery, to an igniter circuit 4 which performs the function of stepping up the relatively low input DC voltage to a relatively high DC voltage that is sufficient to generate a spark in a spark generator 6 to energize an arc discharge lamp 8. In an embodiment, the input DC voltage is converted to a relatively low alternating current (AC) voltage, which is then transformed into a relatively high AC voltage, which is then converted to a high DC voltage for discharge through the spark generator to energize the arc discharge lamp.

Referring to FIG. 1, the igniter circuit 4 comprises a DC to AC converter 10 which performs the function of converting the relatively low input DC voltage to a relatively low AC voltage, an AC transformer 12 which performs the function of transforming the relatively low AC voltage to a relatively high AC voltage, and an AC to DC converter 14 which performs the function of converting the relatively high AC voltage to a relatively high DC voltage. In an embodiment, the DC to AC converter 10 comprises a self-oscillating current-fed push-pull circuit 16 for generating oscillations.

In the embodiment shown in FIG. 1, the self-oscillating current-fed push-pull circuit 16 comprises a pair of npn bipolar transistors 18 and 20 and a resonant capacitor 22, which determines the resonant frequency of oscillation generated by the push-pull circuit 16. In FIG. 1, the resonant capacitor 22 is connected between the collectors 18*a* and 20*a* of the first and second transistors 18 and 20, respectively. The emitters 18*b* and 20*b* of the first and second transistors 18 and 20 are connected together to ground 24.

The base 18*c* of the first transistor 18 is connected to a resistor 26 and two diodes 28 and 30. The anode of the diode 30 is connected to ground 24, while the cathode of the diode 30 is connected to the anode of the diode 28. The cathode of the diode 28 and the resister 26 as well as the collector 20*a* of the second transistor 20 are connected to one end of the primary winding 32 of the AC transformer 12. In a similar manner, two diodes 34 and 36 and a resister 38 are connected to the base 20*c* of the second transistor 20. The anode of the diode 36 is connected to ground 24, while the cathode of the diode 36 is connected to the anode of the diode 34. The cathode of the diode 34 and the resistor 38 as well as the collector 18*a* of the first transistor 18 are connected to another end of the primary winding 32 of the AC transformer 12.

The input DC voltage line 2 is connected through an inductor 40 to an intermediary point 42 of the primary winding 32 of the AC transformer 12. In addition, the AC transformer 12 further comprises a feedback winding 44 which is connected to the self-oscillating current-fed push-pull circuit 16 to provide a feedback to the first and second transistors 18 and 20 to sustain the oscillation produced by the push-pull circuit. In an embodiment, a resistor 46 is connected between a terminal of the feedback winding 44 and the base 20*c* of the second transistor 20, while another terminal of the feedback winding 44 is directly connected to the base 18*c* of the first transistor 18.

In the embodiment shown in FIG. 1, the AC to DC converter 14 comprises two rectifying diodes 48 and 50 connected to the secondary winding 52 of the AC transformer 12. In an embodiment, a high-voltage DC energy storage 54 is provided in the igniter circuit to perform the function of storing the high DC voltage produced by the rectifying diodes 48 and 50. In the embodiment shown in FIG. 1, the high-voltage DC energy storage 54 comprises two capacitors 56 and 58 connected to the rectifying diodes 48 and 50.

In this embodiment, the AC voltage generated by the secondary 52 of the AC transformer 12 produces a current which passes through the first rectifying diode 48 to charge the first capacitor 56 during one half of an AC cycle. During the other half of the AC cycle, the high AC voltage generated by the secondary 52 of the AC transformer 12 charges the second capacitor 58 through the second rectifying diode 50. In this manner, the first capacitor 56 can be charged to a high DC voltage equal to the AC voltage generated by the secondary 52 of the transformer 12 minus the voltage drop across the diode 48, while the second capacitor 58 can be charged to a high DC voltage equal to the AC voltage generated by the secondary 52 of the AC transformer 12 minus the voltage drop across the second rectifying diode 50. The total voltage across the two energy storage capacitors 56 and 58 is thus twice the AC voltage generated by the secondary 52 of the transformer 12 minus the voltage drop across the two rectifying diodes 48 and 50, thereby effectively nearly doubling the voltage generated by the AC transformer.

When the total voltage across the two energy storage capacitors 56 and 58 reaches a sufficiently high value, for example, approximately 2500 volts, the electrical energy stored in the capacitors is discharged through the spark generator 6 to cause ignition of the arc discharge lamp 8. In an embodiment, the spark generator 6, which performs the function of generating sparks to energize the arc discharge lamp 8, comprises first and second electrodes 60 and 62, which are spaced apart from each other forming a spark gap 64. When the capacitors 56 and 58 are charged to a high voltage, for example, approximately 2500 volts to cause a spark in the spark gap 64, the spark gap 64 becomes conductive, thereby transferring the electrical energy stored in the capacitors 56 and 58 to the arc discharge lamp 8. A conventional arc discharge lamp typically has a lamp envelope enclosing a chamber filled with argon and halogens, and two electrodes for generating arc discharge within the gas-filled chamber.

In an example in which the input line 2 of the igniter circuit is connected to a twelve-volt DC power supply, the inductance of the inductor 40 may be on the order of about 100 $\mu$H, while the inductance of the feedback winding 44 may be on the order of about 10 $\mu$H. The resistors 26 and 38 may each have a resistance value on the order of about 33 kΩ, while the resistor 46 may have a resistance value on the order of about 1 kΩ. The resonant capacitor 22 may have a capacitance value on the order of about 0.33 nF, for example, while the energy storage capacitors 56 and 58 may each have a capacitance value of about 1 nF.

The push-pull circuit 16 produces oscillations with a resonant frequency determined by the inductance of the transformer primary and the combined capacitance of the resonant capacitor 22, the output capacitors 56 and 58, and parasitic capacitance, if any, within the transformer 12. The frequency of oscillation generated by the DC to AC converter 10 is not critical as long as an AC voltage is provided across the primary of the transformer 12 for stepping up the AC voltage.

The present invention has been described with respect to particular embodiments thereof, and numerous modifications can be made which are within the scope of the invention as set forth in the claims.

What is claimed is:

1. An igniter circuit, comprising:

a direct current (DC) to alternating current (AC) converter capable of generating a relatively low AC voltage;

a transformer connected to the DC to AC converter to transform the relatively low AC voltage to a relatively high AC voltage;

an AC to DC converter connected to the transformer to convert the relatively high AC voltage to a relatively high DC voltage;

a high-voltage DC energy storage connected to the AC to DC converter to store electrical energy;

a spark generator connected to the high-voltage DC energy storage to generate a spark in response to a discharge of the electrical energy from the high-voltage DC energy storage;

wherein the DC to AC converter comprises a self-oscillating current-fed push-pull circuit;

first and second transistors each having a base, a collector and an emitter, the emitters of the first and second transistors connected to each other; and a resonant capacitor connected between the collectors of the first and second transistors.

2. The circuit of claim 1, wherein the DC to AC converter comprises a self-oscillating current-fed push-pull circuit.

3. The circuit of claim 1, wherein the push-pull circuit further comprises a plurality of diodes connected to the bases of the first and second transistors.

4. The circuit of claim 1, wherein the transformer comprises a feedback winding connected to the push-pull circuit to provide a feedback to the first and second transistors to sustain oscillation.

5. An arc discharge lamp system, comprising:

an arc discharge lamp;

means for stepping up a relatively low input direct current (DC) voltage to a relatively high DC voltage sufficient to generate a spark to energize the arc discharge lamp;

wherein the means for stepping up the relatively low input DC voltage to the relatively high DC voltage comprises:

means for converting the relatively low input DC voltage to a relatively low alternating current (AC) voltage;

means for transforming the relatively low AC voltage to a relatively high AC voltage; and means for converting the relatively high AC voltage to the relatively high DC voltage;

wherein the means for converting the relatively low input DC voltage to the relatively low AC voltage comprises a DC to AC converter;

wherein the means for transforming the relatively low AC voltage to the relatively high AC voltage comprises a transformer connected to the DC to AC converter;

wherein the means for converting the relatively high AC voltage to the relatively high DC voltage comprises an AC to DC converter connected to the transformer;

wherein the DC to AC converter comprises a self-oscillating current-fed push-pull circuit; and wherein the push-pull circuit comprises:

first and second transistors each having a base, a collector and an emitter, the emitters of the first and second transistors connected to each other; and a resonant capacitor connected between the collectors of the first and second transistors.

6. The system of claim, 5, wherein the push-pull circuit further comprises a plurality of diodes connected to the bases of the first and second transistors.

7. The system of claim 5, wherein the transformer comprises a feedback winding connected to the push-pull circuit to provide a feedback to the first and second transistors to sustain oscillation.

8. The system of claim 5, wherein the AC to DC converter comprises at least one rectifying diode.

9. The system of claim 5, further comprising:

means for storing the relatively high DC voltage; and means for generating the spark to energize the arc discharge lamp.

10. The system of claim 9, wherein the means for storing the relatively high DC voltage comprises at least one capacitor connected to the AC to DC converter.

11. The system of claim 10, wherein the means for generating the spark comprises a spark generator connected to said at least one capacitor.

12. The system of claim 11, wherein the spark generator comprises first and second electrodes spaced apart from each other forming a spark gap.

13. The system of claim 12, wherein the spark is generated at a voltage of about 2500 V between the first and second electrodes.

14. A method of energizing an arc discharge lamp, comprising the steps of:

converting a relatively low direct current (DC) voltage to a relatively low alternating current (AC) voltage;

transforming the relatively low AC voltage to a relatively high AC voltage;

converting the relatively high AC voltage to a relatively high DC voltage;

discharging the relatively high DC voltage to energize the arc discharge lamp; and wherein said converting includes doubling substantially the DC voltage to facilitate the discharging;

said discharging includes discharging at least one voltage doubling capacitor; and resonating said voltage doubling capacitor.

15. The method of claim 14, further comprising the step of storing the relatively high DC voltage prior to the step of discharging the relatively high DC voltage to energize the arc discharge lamp.

16. The method of claim 15, wherein the step of storing the relatively high DC voltage is performed by at least one capacitor.

17. The method of claim 14, wherein the step of converting the relatively low DC voltage to the relatively low AC voltage is performed by a self-oscillating current-fed push-pull circuit.

18. The method of claim 14, wherein the step of transforming the relatively low AC voltage to the relatively high AC voltage is performed by an AC transformer.

19. The method of claim 14, wherein the step of converting the relatively high AC voltage to the relatively high DC voltage is performed by at least one rectifying diode.

20. An igniter circuit for a discharge lamp, comprising:

a direct current (DC) to alternating current (AC) converter capable of generating a relatively low AC voltage;

a transformer connected to the DC to AC converter to transform the relatively low AC voltage to a relatively high AC voltage;

an AC to DC converter connected to the transformer to convert the relatively high AC voltage to a relatively high DC voltage;

a high-voltage DC energy storage connected to the AC to DC converter to store electrical energy; and a spark generator connected to the high-voltage DC energy storage to generate a spark in response to a discharge of the electrical energy from high-voltage DC energy storage, said hi-voltage DC energy storage includes a voltage doubling circuit coupled to said spark generator to cause it to connect said hi-voltage DC energy storage to the discharge lamp to ignite it; and said hi-voltage DC energy storage including at least one energy storage capacitor for resonating a resonant frequency;

said high-voltage DC energy storage includes a voltage doubling circuit coupled to said spark generator to cause it to connect said high-voltage DC energy storage to the discharge lamp to ignite it; and said high-voltage DC energy storage including at least one energy storage capacitor for resonating at a resonant frequency.

21. The circuit of claim 20, wherein the AC to DC converter comprises at least one rectifying diode.

22. The circuit of claim 21, wherein the high-voltage DC energy storage comprises at least one capacitor connected to said at least one rectifying diode, said at least one capacitor capable of discharging the electrical energy to the spark generator.

23. The circuit of claim 20, wherein the spark generator comprises first and second electrodes spaced apart from each other forming a spark gap.

24. The circuit of claim 23, wherein the spark is generated at a voltage of about 2500 V between the first and second electrodes.

* * * * *

UNITED STATES PATENT AND TRADEMARK OFFICE

CERTIFICATE OF CORRECTION

PATENT NO. : 6,624,585 B2
DATED : September 23, 2003
INVENTOR(S) : Pruett

It is certified that error appears in the above-identified patent and that said Letters Patent is hereby corrected as shown below:

Column 3,
Line 35, "about 0.33nF," should read -- about 33 nF, --.

Column 6,
Lines 13, 15 and 18, "hi-voltage" should read -- high-voltage --.

Signed and Sealed this

Fourth Day of January, 2005

JON W. DUDAS
*Director of the United States Patent and Trademark Office*